US006450905B1

(12) United States Patent
Edlund

(10) Patent No.: US 6,450,905 B1
(45) Date of Patent: Sep. 17, 2002

(54) ARROW DELIVERED SCENT DISPERSION APPARATUS

(75) Inventor: Robert LeRoy Edlund, Fargo, ND (US)

(73) Assignee: Pee Wee's, Inc., Fargo, ND (US)

( * ) Notice: Subject to any disclaimer, the term of this patent is extended or adjusted under 35 U.S.C. 154(b) by 6 days.

(21) Appl. No.: 09/809,939

(22) Filed: Mar. 15, 2001

(51) Int. Cl.[7] ..... F42B 6/04
(52) U.S. Cl. ..... 473/581; 239/145
(58) Field of Search ..... 239/145, 289; 473/578, 581

(56) References Cited

U.S. PATENT DOCUMENTS

| | | | | |
|---|---|---|---|---|
| 3,066,940 | A | 12/1962 | De Lonais | 273/106.5 |
| 3,150,875 | A | 9/1964 | Searles | 273/106.5 |
| 4,463,953 | A | 8/1984 | Jordan | 273/418 |
| 4,726,584 | A | 2/1988 | Bishop | 273/418 |
| 4,881,743 | A | 11/1989 | Fiorenzo | 273/418 |
| 5,035,435 | A | 7/1991 | Burgeson et al. | 273/418 |
| 5,123,657 | A | 6/1992 | Colt et al. | 273/418 |
| 5,183,259 | A | 2/1993 | Lyon | 273/418 |
| 5,269,535 | A | 12/1993 | Gagne | 273/420 |
| 5,836,842 | A | 11/1998 | McLearan | 473/581 |
| 6,027,036 | A | 2/2000 | Taylor | 239/53 |
| 6,174,251 | B1 | 1/2001 | Lemote | 473/581 |

*Primary Examiner*—John A. Ricci
(74) *Attorney, Agent, or Firm*—Curtis V. Harr

(57) ABSTRACT

A scent dispersion apparatus for delivery via an arrow shot by a bow. The apparatus uses an arrow tip using a compression fitting for attaching to the arrow shaft. A scent dispersion head slidably fits over the arrow tip, and contains a sponge which holds liquid scent. The arrow tip acts like a plunger to force the scent liquid out upon target impact. The arrow tip includes O-rings to hold the dispersion head in place until target impact.

20 Claims, 3 Drawing Sheets

FIG 1
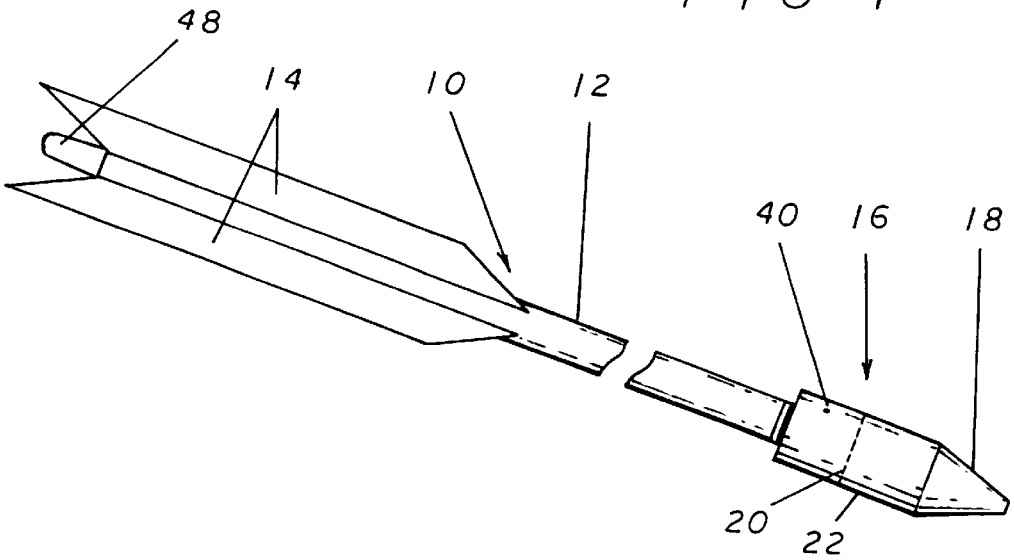
FIG 2
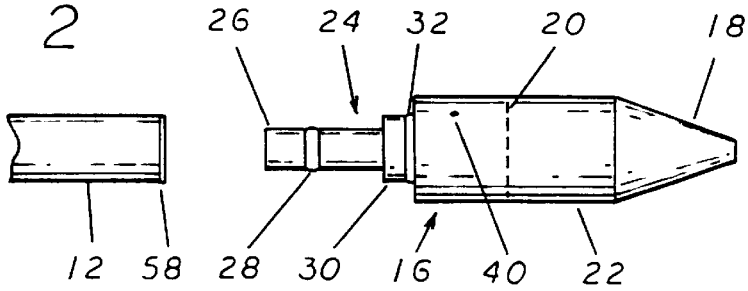
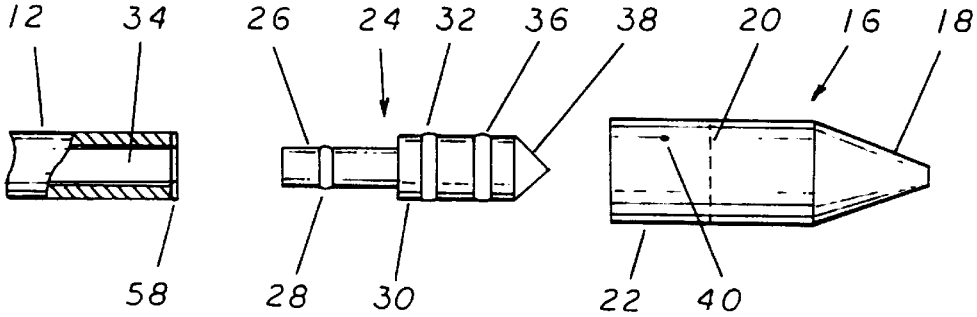
FIG 3

FIG 4
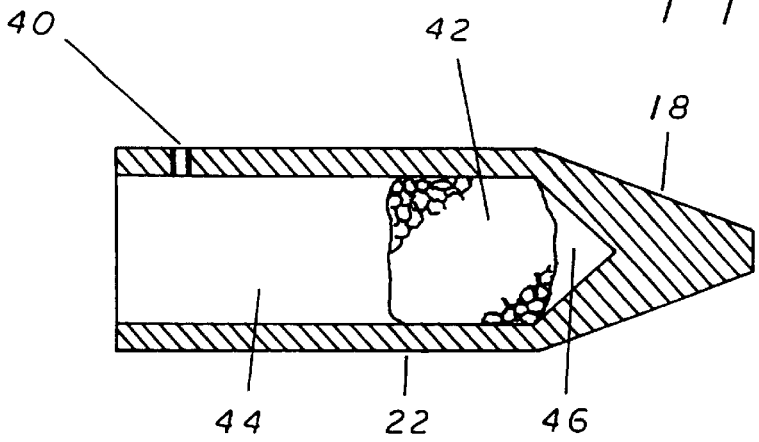
FIG 5
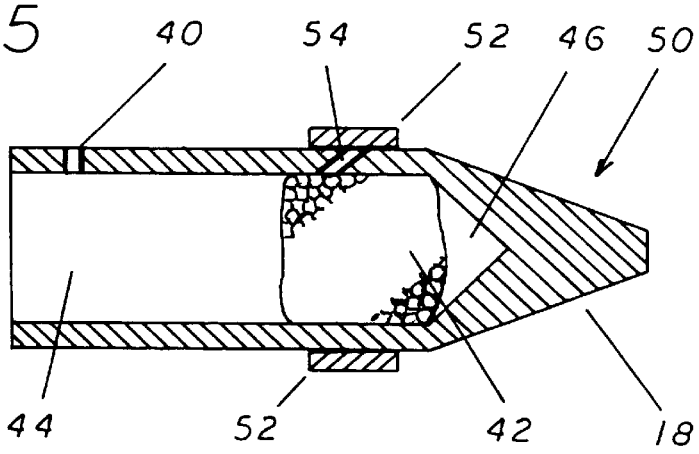
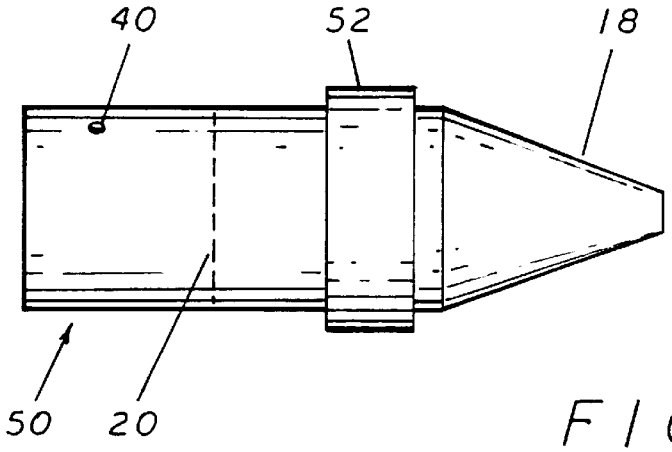
FIG 6

FIG 7
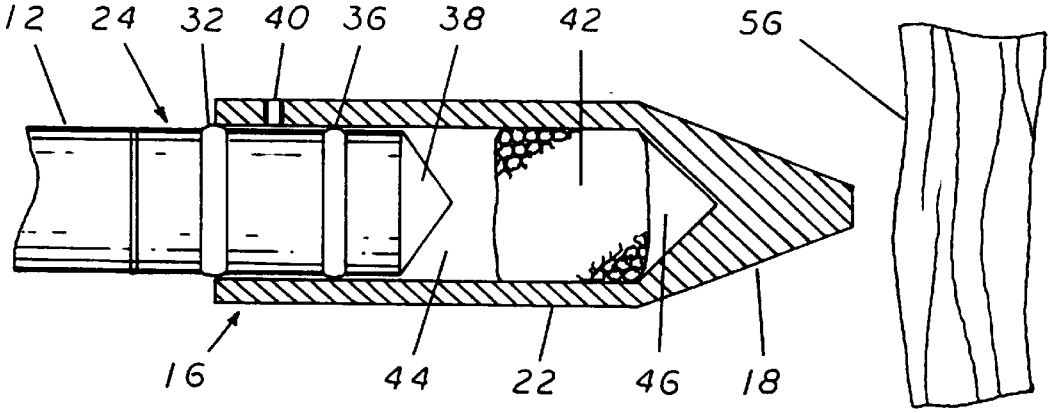
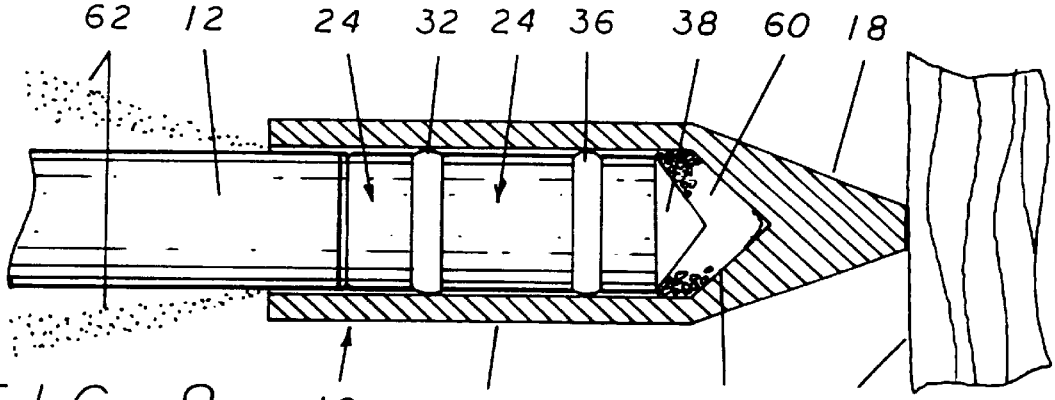
FIG 8
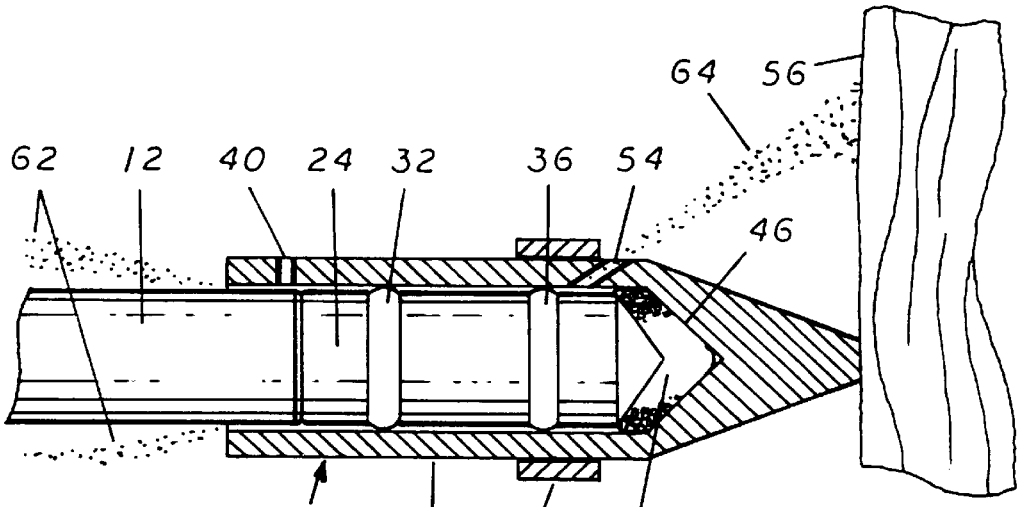
FIG 9

ARROW DELIVERED SCENT DISPERSION APPARATUS

BACKGROUND OF THE INVENTION

The present invention relates to an improvement in the method used to deliver scent while hunting and game watching. More specifically, to an arrow equipped with an apparatus used to deliver scent via an arrow to a remote location.

In the sport of bow and arrow hunting, a hunter typically seeks out a spot and awaits game from a blind. As the range of an arrow is not nearly as great as that of a gun, it is necessary to be relatively close to the game when bow hunting. Thus, the use of scents can be very important as animals are extremely sensitive to the human smell. Further, scents may be used to lure game into a desired location. Often times hunters may use a bottle or spray to place scent to either attract game or to cover the hunters scent.

It has been found that it may be useful for a hunter to deliver scent via an arrow, especially if a hunter is in a blind such as a high tree blind and needs to place scent at a remote location without exiting the blind and alerting nearby game to the hunters presence. Scent dispersing arrows have been described in existing patents including U.S. Pat. No. 5,836.842 and U.S. Pat. No. 5,123,657. These patents both disclose the use of a specially equipped arrow with a head that is used for dispersing scent. Generally the arrows will use some sort of cartridge and, due to the design, may be relatively expensive as the design requires that a specially equipped arrow be sold with the head and cartridges.

The present disclosure overcomes these disadvantages and provides an improved product for use by a bow hunter to attract game and cover ones scent by allowing the present invention to be used with a standard arrow without the need for a specially prepared arrow.

SUMMARY OF THE INVENTION

It is the primary objective of the present invention to provide a method by which a bow and arrow hunter can effectively disperse small amounts of scent liquid, commonly used to lure game animals into firing range or to mask the human scent, onto specific targets from a relatively large distance.

It is an additional objective of the present invention to provide such a method which allows for the dispersion of such scenting liquids onto specific targets without the hunter having to actually enter the area of the scent targets. This feature of the present invention eliminates the possibility of the hunter contaminating the target area with his own scent which is very important to the success of the hunt as human scent tends to frighten the game animals away.

It is a further objective of the present invention to provide such a method of scenting liquid dispersion which will allow a bow and arrow hunter to easily scent a large number of targets from a centrally located position which will increase the effectiveness of his hunt.

It is a still further objective of the present invention to provide such a method of scenting liquid dispersion that can be manufactured in an inexpensive manner which will allow for its greater use by the average bow and arrow hunter.

These objectives are accomplished by the use of a standard and commonly available arrow which is made up of an elongated hollow shaft having its forward end open and its rearward end closed off by a notched bowstring engagement cap. Additionally, the rearward portion of the arrow shaft generally contains three outwardly protruding guide fins which help to stabilize the arrow during flight. Finally, the forward end of the arrow shaft terminates in a hollow opening into which the primary components of the present invention are mounted.

The attachment of the scent dispersion head to the forward end of the arrow shaft is accomplished by a compression fitting between the rearward extending mount shaft of the dispersion arrow head tip and the inner wall of the standard arrow shaft. This fitting is accomplished by machining the outside diameter of the mount shaft to match the inside diameter of the arrow shaft. The mount shaft is then simply slipped into the open end of the arrow shaft to install the present invention on the arrow. Additionally, this compression fitting is augmented by the use of an O-ring installed in a machined groove in the outer surface of the mount shaft which contacts the inside surface of the arrow shaft prior to the normal threaded portion of the shaft and increases the friction between the two components which secures the connection.

The scent dispersion head also contains the dispersion head arrow tip which is larger in its outside diameter than the mount shaft and located forward of it. The dispersion head arrow tip is roughly analogous in size and shape to a standard field arrow head and functions to both hold the dispersion head cap in the proper location and to act like a plunger to force the scent liquid out upon target impact. Like the mount shaft, the arrow tip employs an O-ring compression fitting system used to hold the dispersion head cap securely in place until the point of target impact.

The dispersion head cap is a relatively short and hollow tube having an open rear end and a closed off conically pointed tip. The closed off forward end of the interior of the dispersion head cap provides the point of location for the scent sponge which holds the liquid scent in the proper location within the dispersion head cap. With the scent in place, the open rear end of the dispersion head cap is fitted on to the arrow tip in such a fashion as to leave a space between the forward end of the arrow tip and the closed end of the interior of the dispersion head cap.

Upon impact with a target, the O-ring mounting system of the dispersion head cap to the arrow tip allows the dispersion head cap to move rearward in relation to the arrow tip. This rearward movement compresses the scent sponge which forces the liquid scent rearward by the O-rings and out of the dispersion head cap. The liquid scent is in this fashion distributed in a rearward fan pattern to a distance of eight to ten feet which will aid in luring game animals into the desired area.

A second embodiment of the present invention uses a small hole placed in the dispersion head cap near the conically pointed tip. This hole may be covered with a plastic ring in order to seal the dispersion tip. Upon impact, liquid scent is distributed in a rearward fan pattern as described above and is also distributed out this hole in a forward type fan pattern by moving the plastic ring backward upon impact.

The impact of the present invention with a solid target produces one of three different results all of which effectively distribute the scent liquid contained in the dispersion head cap. The first of these is that the internal metallic arrow tip penetrates the conical tip of the dispersion head cap which disintegrates the head cap and leaves the arrow head stuck into the surface of the target. This result does not affect the dispersal of. the liquid scent as the shattering of the dispersion head cap actually aids in dispersing the scent in the general area of the impact. Additionally, the inexpensive nature of the construction of the dispersion head cap means that the breaking of the head cap in this circumstance has a very small financial impact on the hunter.

The second possibility is that the arrow and the dispersion head cap bounce back fully intact, yet separate, after impacting the surface of the target. The dispersion of the liquid scent operates exactly as described above by forcing the scent by the O-ring seals and out of the back of the head cap.

Finally, the third possibility is that the arrow tip itself can also become detached from the body of the arrow at target impact. This has no effect on the dispersion of the scent either as it occurs after the dispersion phase of the invention's operation. It is also worthwhile to note that the sponge retains a significant amount of scent after. target impact and that in all three circumstances the sponge remains intact and either on the ground around the target or pinched between the arrow tip and the surface of the target. In either case the scent retained in the sponge enhances the overall effect of the invention because of its scent retaining characteristics.

For a better understanding of the present invention reference should be made to the drawings and the description in which there are illustrated and described preferred embodiments of the present invention.

DESCRIPTION OF THE DRAWINGS

FIG. 1 is a side elevation view of the present invention which illustrates the manner in which the scent dispersion head is fitted to the forward portion of a standard arrow.

FIG. 2 is a side elevation partially exploded view of a the present invention detailing the dispersion head attachment method which employs a specially designed arrow tip that is fitted into the end of the arrow shaft and which also provides the point of attachment for the scent holding dispersion head cap component of the invention.

FIG. 3 is a top elevation exploded view of the present invention detailing the manner of construction of the arrow shaft, the arrow tip, and the head cap components and their relationship to one another.

FIG. 4 is a side elevation cut-away view of the head cap component of the present invention and details the manner of its internal construction including the general location of the scent sponge.

FIG. 5 is a side elevation cut-away view of the head cap component of an alternative embodiment of the present invention which employs the use of a forward oriented dispersion orifice and a anti-leak ring used to keep the scent within the dispersion head until the appropriate time.

FIG. 6 is a side elevation view of the head cap component of the alternative embodiment of the present invention which further illustrates the positioning of the anti-leak ring in relation to the remainder of the invention.

FIG. 7 is a side elevation cut-away view of the arrow shaft, arrow tip, and head cap components of the present invention and which illustrates their relative position just before impact and the release of the contained scent.

FIG. 8 is a side elevation cut-away view of the arrow shaft, arrow tip, and head cap components of the present invention and which illustrates their relative position at the point of impact and during the scent release phase of the invention's normal operation.

FIG. 9 is a side elevation cut-away view of the arrow shaft, arrow tip, and head cap components of the alternative embodiment of the present invention and which illustrates their relative position at the point of impact and during the scent release phase of the its normal operation.

DESCRIPTION OF THE PREFERRED EMBODIMENT:

Referring now to the drawings, and more specifically to FIG. 1, the scent dispersion head 16 is fitted to the most forward end of a typical arrow 10 for use by a bow hunter. The arrow 10 is generally made up of an elongated arrow shaft 12 having an open forward end and a rearward end that is closed off by the use of the notched end cap 48. It is the notched end cap that is used to engage the bowstring of the bow prior to the firing of the arrow 10. Additionally, the rearward portion of the arrow shaft 12 contains three radially oriented and outwardly protruding guide fins 14 which function to stabilize the arrow 10 in flight which enhances its overall accuracy.

The scent dispersion head 16 fits onto the most forward end of the arrow shaft 12 and is generally made up of a hollow cylindrical body, or the dispersion head cap 22, having an open rearward end and a closed off conical tip 18. The interior of the dispersion head cap 22 is used to contain a small amount of liquid scent; the exterior features are highlighted by the scent maximum fill line 20 which is a dashed line that circles the exterior of the dispersion head cap 22 and gives the user a clear indication of the maximum amount of liquid scent to add to the invention to ensure that it functions properly. The other notable feature of the exterior is the air release hole 40 which is a small hole in the wall of the dispersion head cap 22 located between the scent maximum fill line 20 and the rear of the dispersion head cap 22.

The manner in which the scent dispersion head 16 is attached to the forward end of the arrow shaft 12 is further detailed in FIGS. 2 and 3. The forward most portion of the arrow shaft 12 is fitted with a metallic arrow tip insert 58 which provides a more durable mounting surface than the fiberglass that is typically used in the construction of arrow shafts 12. The arrow tip insert 58 is essentially a sleeve that lines the inside wall of the most forward section of the arrow shaft 12 and is the point of contact where the tip mount shaft 26 of the arrow tip 24 engages the arrow shaft 12.

The attachment of the arrow tip 24 to the forward portion of the arrow shaft 12 is accomplished with a friction fitting in that the outside diameter of the tip mount shaft 26 portion of the arrow tip 24 is just smaller than the inside diameter of the sleeve portion of the arrow tip insert 58. Thus,. the tip mount shaft is slid into the open end of the arrow shaft 12 and into the arrow shaft core 34 where it engages the arrow tip insert 58. Additionally, the tip mount shaft 26 is also equipped with a machined groove that provides the mounting point for the shaft O-ring seal 28. The function of the shaft O-ring seal 28 is to enhance the friction fitting between the tip mount shaft 26 and the sleeve portion of the arrow tip insert 58 by providing a high friction contact surface between the two components effectively locking them in place.

The arrow tip 24 also contains the tip body 30 which comprises the larger portion of the arrow tip 24 and is the same diameter as the outside of the arrow shaft 12. The tip body 30 is the component of the present invention which provides for the mounting of the of the liquid scent containing dispersion head cap 22 to the body of the invention. The fitting of the dispersion head cap 22 to the tip body 30 works in a similar fashion to the connection of the tip mount shaft 26 to the arrow tip insert 58, that is to say that the attachment is also accomplished by the use of a friction fitting between the two. Additionally, the tip body 30 is also equipped with two machined grooves positioned to hold the outer and inner O-rings, 32 and 36. The outer and inner O-rings, 32 and 36, serve two primary functions. The first of these is to provide friction surfaces to enhance the attachment of the dispersion head cap 22 to the tip body 30. The second function of the outer and inner O-rings, 32 and 36, is to help retain the liquid scent within the dispersion head cap 22 prior to its impacting a target. Also, the tip body is designed with a conical tip head 38 which aids in the dispersion of the liquid scent upon target impact.

The air release hole 40 feature of the dispersion head cap 22 as previously discussed operates in conjunction with the attachment of the dispersion head cap 22 to the arrow tip 24. This is a function of the closed nature of the forward end of the dispersion head cap 22 and the friction seal of the outer and inner O-rings, 32 and 36. The problem is created as the dispersion head cap 22 is slid over the tip body 30 it tends to compress the air trapped within the dispersion head cap 22. If there is no mechanism provided to release this compressed air it will act to push the dispersion head cap 22 off of the tip body 30 and detract from the overall effectiveness of the present invention. Thus, the positioning of the air release hole 40 allows the compressed air from inside of the dispersion head cap 22 during the installation process which ensures a adequate seal between these components.

The internal construction of the dispersion head cap 22 is further illustrated in FIG. 4. The internal cavity of the dispersion head cap 22 is primarily made up of the plunger cavity 44 which at its forward end provides the space for the placement of the scent sponge 42. The scent sponge 42 operates to hold the liquid scent within the plunger cavity 44 in a manner that limits its leak potential and within a device (the scent sponge 42) that is compressible. The compressible nature of the scent sponge 42 enhances the dispersal of the scent upon target impact. The most forward portion of the interior of the dispersion head cap 22 is made up of the compression sponge cavity 46. The compression sponge cavity 46 tapers to a conically shaped point that roughly coincides with the shape of the conical tip head 38 portion of the tip body 30 and these coinciding shapes help compress the scent sponge 42 upon target impact which aids in the dispersal of the liquid scent.

The interior operation of the present invention upon target impact is detailed in FIGS. 7 and 8:. These FIGS. illustrate the interior of the dispersion head cap 22 prior to and during target impact and also the relative positions of the invention's major components during these two phases of operation. Just prior to impacting the surface of a tree 56 (as illustrated in FIG. 7), the dispersion head cap 22 remains in its set position having its rearward most surface just touching the outer O-ring seal 32. This positioning of the dispersion head cap 22 creates the proper spacing within the plunger cavity 4:4 between the conical tip head 38 of the tip body 30, the scent sponge 42, and the compression sponge cavity 46. This spacing is critical to the operation of the invention as it allows for the proper compression of the internal air and scent sponge 42 to facilitate the optimal dispersion pattern for the liquid scent.

Upon impacting the surface of the target tree 56 (as illustrated in FIG. 8), the forward motion of the dispersion head cap 22 is stopped while the arrow tip 24 continues forward within the plunger cavity 44. This forward motion forces the internal air and compressed sponge 60 forward into the compression sponge cavity 46. The incompressible nature of liquids along with the pressure created by the compression of the internal air forces the liquid scent rearward by the inner and outer O-ring seals, 36 and 32, and out the rear of the dispersion head cap 22. This creates a fine rearward scent spray 62 that extends back for a distance of seven to ten feet. Thus, the liquid scent contained within the dispersion head cap 22 can be dispersed in any desired location.

An alternative embodiment of the present invention is illustrated in FIGS. 5, 6, and 9. This embodiment of the invention employs a forward spray dispersion head cap 50 which, when impacting the surface of a tree 56, results in a forward scent spray 64 that deposits a portion of the liquid scent contained in the forward spray dispersion head cap 50 onto the tree 56. The primary mechanism by which this is accomplished is the forward dispersion orifice 54 which is a small channel leading from the compression sponge cavity 46 to the exterior of the forward spray dispersion head cap 50. Importantly, the forward dispersion orifice is angled sharply forward, in relation to the overall orientation of the invention, from its starting point in the compression sponge cavity 46 to its terminus on the exterior of the invention. This angle of the forward dispersion orifice 54 ensures that any liquid scent forced through it at impact will eject in a forward manner thereby thoroughly scenting the surface of the impacted tree 56.

Additionally, this embodiment of the present invention also employs a anti-leak ring 52 which is a relatively thin walled ring that the user places over the outside surface of the forward spray dispersion head cap 50 in a manner so that it blocks the outer opening of the forward dispersion orifice 54. The use of the anti-leak ring 52 ensures that liquid scent contained within the forward spray dispersion head cap 50 will not leak out prior to its impacting a target.

The results of the alternative embodiment's impact of a target tree 56 are detailed in FIG. 9. The primary difference with this embodiment is the presence of the forward dispersion orifice 54 which, upon impact, results in a forward scent spray 64 that scents the area of impact on the tree 56. This action is a result of the same processes as in the previously described embodiment (referring to the forward motion on impact of the arrow tip 24 resulting in the compressed scent sponge 60 and the subsequent ejection of the liquid scent contained therein) with the exception that there must be a mechanism to clear the anti-leak ring 52 from the opening of the forward dispersion orifice 54 to allow the liquid scent to pass freely forward. This is accomplished as a function of the pressure created within the forward spray dispersion head cap 50 upon impact as this pressure causes the anti-leak ring 52 to move sharply rearward which clears the opening allowing for the forward dispersal of liquid scent. Thus, this embodiment of the present invention provides a method of not only dispersing liquid scent in a rearward manner but also a mechanism by which scent can be deposited on the surface of the impacted object. This allows for a greater dispersion pattern of the scent which will enhance the effectiveness of the hunt in general.

Although the present invention has been described in considerable detail with reference to certain preferred versions thereof, other versions are possible. Therefore, the spirit and scope of the appended claims should not be limited to the description of the preferred versions contained herein.

What is claimed is:

1. A scent delivery device for use with an arrow having a tubular shaft with a nock and guide fins at a rear end and a front end for receiving said scent delivery device, said scent delivery device comprising:

an arrow tip having a rear tip mount shaft and forward tip body, said tip body having a diameter greater than that of said tip mount shaft;

a cylindrically shaped scent dispersion head having an open rear end and a closed front end said scent dispersion head defining a hollow inner cavity for receiving said tip body of said arrow tip; and a piece of porous material in said scent dispersion head.

2. A scent delivery device as in claim 1 wherein said scent dispersion head defines an air release hole in the side of said scent dispersion head near said open rear end.

3. A scent delivery device as in claim 2 wherein said scent dispersion head further comprises a conically shaped front tip.

4. A scent delivery device as in claim 3 wherein said tip mount shaft further comprises a center O-ring section for holding said tip mount shaft within said front end of said arrow.

5. A scent delivery device as in claim 4 wherein said tip body further comprises a first and second O-ring section for holding said tip body within said scent dispersion head.

6. A scent delivery device as in claim 5 further comprising a maximum fill line indicia on the outer surface of said scent dispersion head between said air release hole and said front tip.

7. A scent delivery device for use with an arrow having a tubular shaft with a nock and guide fins at a rear end and a front end for receiving said scent delivery device, said scent delivery device comprising:

an arrow tip having a rear tip mount shaft and forward tip body, said tip body having a diameter greater than that of said tip mount shaft;

a cylindrically shaped scent dispersion head having an open rear end and a closed front end said scent dispersion head defining a hollow inner cavity for receiving said tip body of said arrow tip, said scent dispersion head further defining a forward spray dispersion hole in the side of said scent dispersion head near said front end;

a ring placed about said scent dispersion head so as to cover said forward spray dispersion hole; and a piece of porous material in said scent dispersion head.

8. A scent delivery device as in claim 7 wherein said scent dispersion head defines an air release hole in the side of said scent dispersion head near said open rear end.

9. A scent delivery device as in claim 8 wherein said scent dispersion head further comprises a conically shaped front tip.

10. A scent delivery device as in claim 9 wherein said tip mount shaft further comprises a center O-ring section for holding said tip mount shaft within said front end of said arrow.

11. A scent delivery device as in claim 10 wherein said tip body further comprises a first and second O-ring section for holding said tip body within said scent dispersion head.

12. A scent delivery device as in claim 11 further comprising a maximum fill line indicia on the outer surface of said scent dispersion head between said air release hole and said front tip.

13. A scent delivery device comprising:

an arrow having a tubular shaft with a nock and guide fins at a rear end and a front end;

an arrow tip having a rear tip mount shaft for connection to said front end of said arrow and a forward tip body, said tip body having a diameter greater than that of said tip mount shaft;

a cylindrically shaped scent dispersion head having an open rear end and a closed front end said scent dispersion head defining a hollow inner cavity for receiving said tip body of said arrow tip; and a piece of porous material in said scent dispersion head.

14. A scent delivery device as in claim 13 wherein said scent dispersion head defines an air release hole in the side of said scent dispersion head near said open rear end.

15. A scent delivery device as in claim 14 wherein said scent dispersion head further comprises a conically shaped front tip.

16. A scent delivery device as in claim 15 wherein said tip mount shaft further comprises a center O-ring section for holding said tip mount shaft within said front end of said arrow.

17. A scent delivery device as in claim 16 wherein said tip body further comprises a first and second O-ring section for holding said tip body within said scent dispersion head.

18. A scent delivery device as in claim 17 further comprising a fill line indicia on the outer surface of said scent dispersion head between said air release hole and said front tip.

19. A scent delivery device as in claim 13 wherein said scent dispersion head further defines a forward spray dispersion hole in the side of said scent dispersion head near said front end.

20. A scent delivery device as in claim 19 further comprising a ring placed about said scent dispersion head so as to cover said forward spray dispersion hole.

* * * * *